US005199245A

United States Patent [19]

Daddario et al.

[11] Patent Number: 5,199,245

[45] Date of Patent: Apr. 6, 1993

[54] METHOD AND APPARATUS FOR PACKAGING CLOTH ARTICLES

[76] Inventors: Leo Daddario; Antonio Peixeiro, both c/o Europak Packaging Machinery Inc., 1155 Autoroute 13, Laval, Quebec, Canada, H7W 5J8

[21] Appl. No.: 769,456

[22] Filed: Oct. 1, 1991

[51] Int. Cl.[5] ..... B65B 35/50

[52] U.S. Cl. ..... 53/447; 53/237; 53/451; 53/540; 53/551; 406/192

[58] Field of Search ..... 406/62, 76, 89, 91, 406/151, 176, 180, 192; 53/117, 152, 153, 237, 247, 284.7, 443, 447, 451, 475, 531, 540, 551, 552; 221/121, 175, 176

[56] References Cited

U.S. PATENT DOCUMENTS

| | | | |
|---|---|---|---|
| 2,773,658 | 12/1956 | Van Otteren et al. | 406/76 X |
| 2,994,561 | 8/1961 | Kelley | 406/79 |
| 3,040,490 | 6/1962 | Virta | 53/551 X |
| 3,045,404 | 7/1962 | Wilson | 53/551 |
| 3,129,979 | 4/1964 | Hartshorn | 406/12 |
| 3,207,559 | 9/1965 | Poteat et al. | 406/31 |
| 3,574,409 | 4/1971 | Furstenberg | 406/192 X |
| 3,626,997 | 12/1971 | Whitaker et al. | 53/451 X |
| 3,724,163 | 4/1973 | Roussel | 53/552 X |
| 4,052,837 | 10/1977 | Saintonge | 53/531 X |
| 4,738,287 | 4/1988 | Klinkel | 53/551 X |

*Primary Examiner*—John Sipos
*Assistant Examiner*—Daniel B. Moon

[57] ABSTRACT

A method and an apparatus for automatically packaging small cloth articles, such as nylon stockings, in bags. The packaging machine comprises two or more loading conduits each having a loading end and a discharge end. A vacuum system is associated with the conduits for conveying the cloth articles therein. A retention housing is provided at the discharge end of each of the loading conduits to retain the cloth article introduced at the loading end. A piston head is displaced in the conduit at the discharge end to transfer the cloth articles in the retention housings of all of the conduits simultaneously and into an associated discharge container. The containers are mounted on a turret and are displaced, serially, to a discharge position where a predetermined number of articles contained within the containers are transferred into a bag.

13 Claims, 5 Drawing Sheets 13
13
25
24
25
14
14
16
21
41
49
48
46
12
47
11

METHOD AND APPARATUS FOR PACKAGING CLOTH ARTICLES

BACKGROUND OF INVENTION

1. Field of Invention

The present invention relates to a method and a machine for automatically packaging small cloth articles, such as nylon stockings, into a containment means, such as a plastic bag.

2. Description of Prior Art

Various automatic machines have been devised to automatically package small cloth articles in bags. Such machines have been adequate when a single article is packaged in a bag, but when it is necessary to insert more than one cloth articles, such as stockings, within a package or bag, this is usually done manually.

SUMMARY OF INVENTION

The present invention was devised primarily, but not exclusively, for packaging nylon stockings into plastic bags wherein two or more stockings have to be automatically inserted into a single bag.

According to another feature of the present invention there is provided a method and a machine for automatically loading small cloth articles, such as stockings, into retention containers which accumulate a predetermined number of these articles, and then automatically unloads them into a plastic bag.

According to a broad aspect of the present invention there is provided a packaging machine for inserting two or more cloth articles in a containment means. The machine comprises two or more loading conduits each having a loading end and a discharge end. Controlled airflow means is associated with the conduits for conveying the cloth articles therein. Retention means is provided at the discharge end of each of the loading conduits to retain the cloth articles introduced at the loading end. Transfer means is provided to simultaneously transfer the cloth articles in the retention means of the loading conduits into an associated discharge means. Unloading means is provided to discharge a predetermined number of cloth articles positioned in the discharge means into a containment means.

According to a still further broad aspect of the present invention there is provided a method of packaging two or more cloth articles, such as nylon stockings, in a containment means. The method comprises the steps of conveying a cloth article in each of two or more loading conduits by controlled airflow means. The cloth articles are retained in a retention means associated with each of the loading conduits. The cloth articles are then simultaneously transferred from the retention means of a holding conduit into associated ones of three or more discharge means. A predetermined number of these articles are accumulated in the discharge means, and one of the discharge means, having a predetermined quantity of accumulated cloth articles, is discharged at a discharge position.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
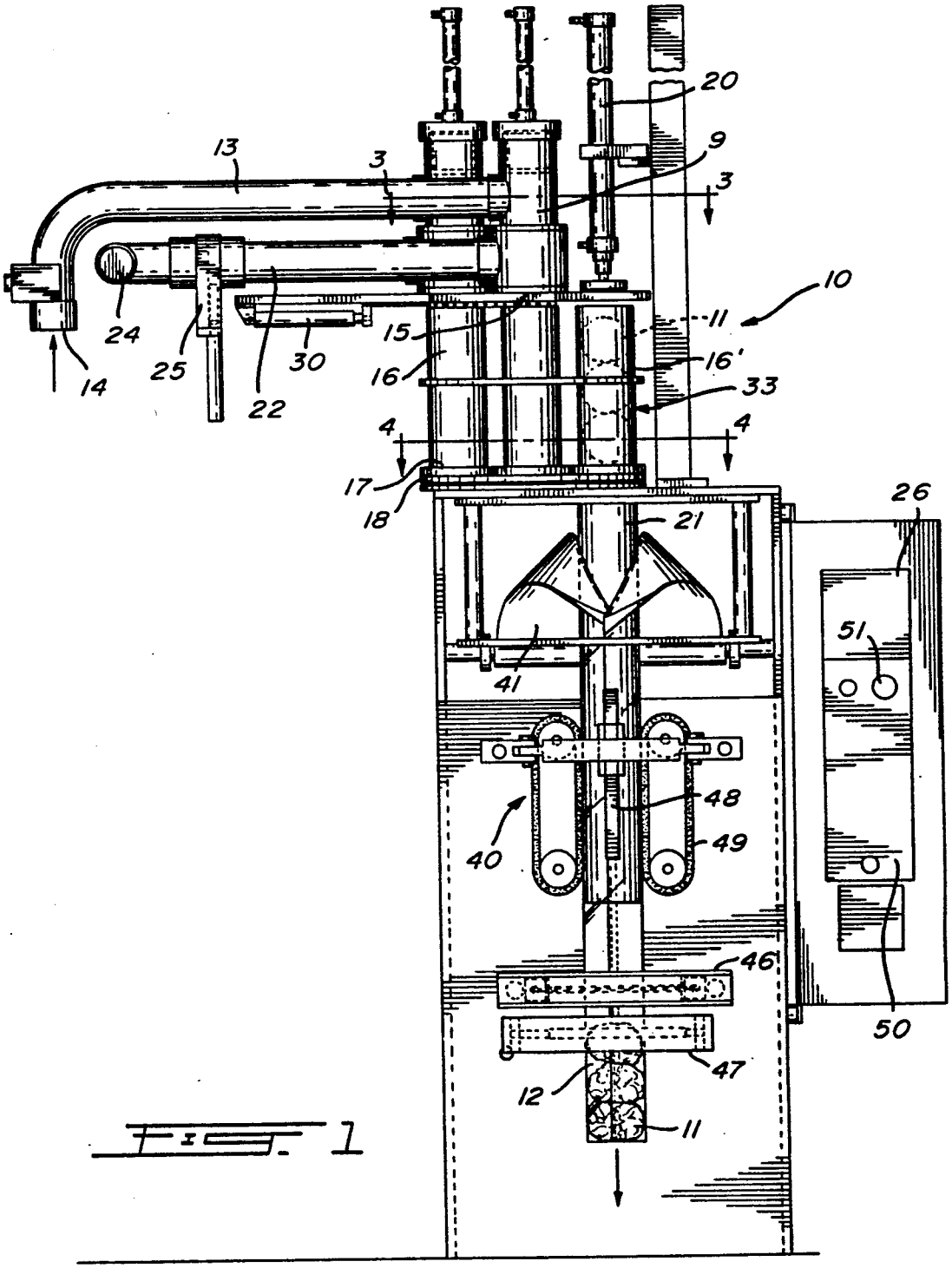
FIG. 1 is a front view of the packaging machine of the present invention.
Figure 3:
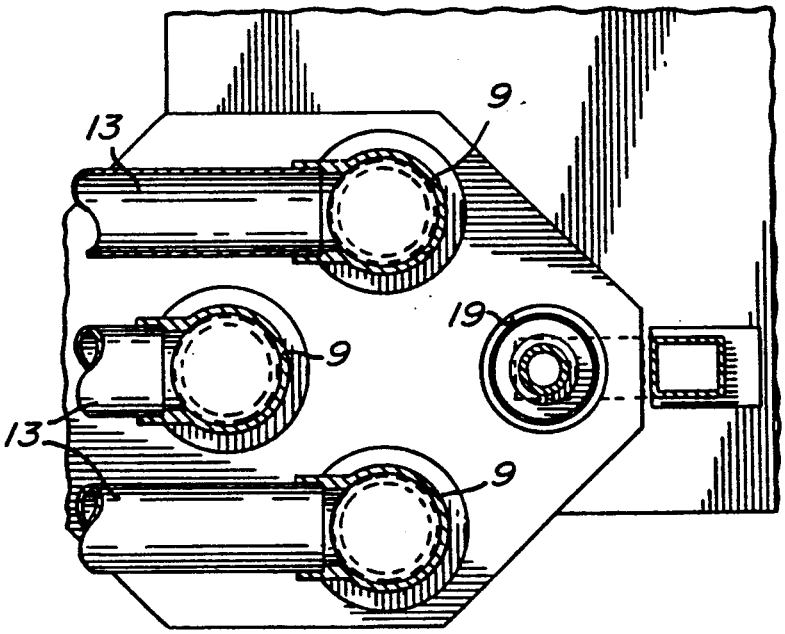
FIG. 3 is a cross-section view along cross-section lines 3—3 of FIG. 1.

Referring now to the drawings, there is shown generally at 10, in FIG. 1, the packaging machine of the present invention for packaging two or more cloth articles, such as nylon stockings or panty hose 11 into a plastic bag containment means 12. The machine comprises two or more, herein three loading conduits 13, having a loading end 14 and a discharge end 15 as is better seen in FIGS. 3 and 5. The loading conduits 13 have a transverse cylindrical portion 9 which is a straight pipe portion aligned with a respective one of three discharge containers 16 mounted on a support turret 17. There are four discharge containers 16 interconnected together in specific relationship and rotatably displaceable over a stationary flat bottom wall surface 18. The containers are open-ended cylinders closed at a bottom end by the wall surface 18. The bottom support surface has a discharge opening 19 therein at a discharge position as indicated by the position of discharge container 16' in FIG. 1. After the discharge containers 16 are loaded with a predetermined quantity of cloth articles 11, they are displaced serially to the discharge position where they are each unloaded, in sequence, by the unloading piston 20. The piston 20 pushes the articles into an elongated cylinder 21 and at the bottom of which is located the plastic bag 12. This portion of the apparatus will be described later.

As shown in FIG. 1, the loading conduits 13 have an exit conduit section 22 which is connected to a vacuum line 24. A valve 25 selectively connects one of the three conduits 13 to the vacuum line, and this is done sequentially by a control circuit 26.

Figure 6:
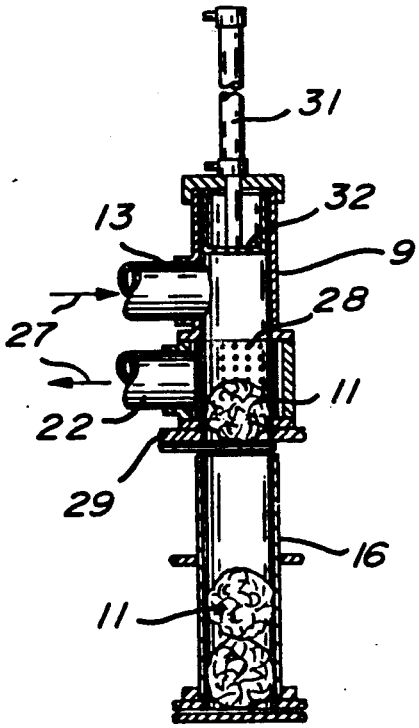
FIG. 6 is a side section view showing the position of the retention housing in the loading conduit relative to the discharge containers secured to the turret.
Figure 7:
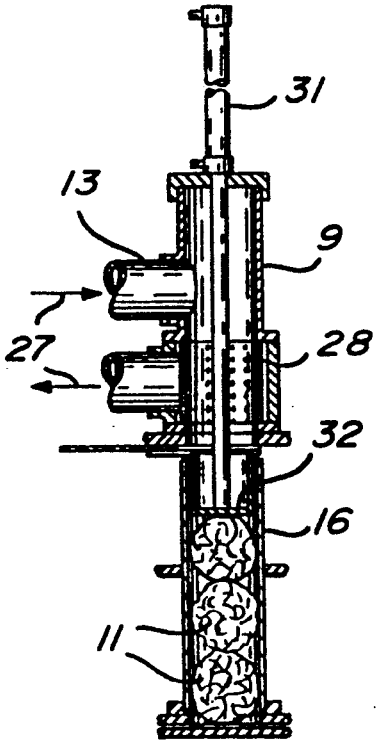
FIG. 7 is a view similar to FIG. 6, but showing the three cloth articles being transferred into the discharge containers by a piston associated with the loading conduit.

As shown in FIGS. 6 and 7, when a cloth article 11 is introduced at the loading end 14 of the conduit 13, it is directed by the airflow, indicated by arrows 27, into an open-ended perforated cylinder housing 28 supported in the transfer cylinder portion 9 adjacent the exit conduit section 22. The perforations permit the airflow to pass through the housing 28 and the articles to be arrested therein. The housing 28 is an open-ended housing with the bottom open end thereof being supported over a discharge gate 29, which is shown in FIGS. 6 and 7 as being in an open condition. All of the gates 29 of each of the transfer cylinder portions 16 are operated automatically and simultaneously by a piston 30 also controlled by the control circuit 26.

Figure 4:
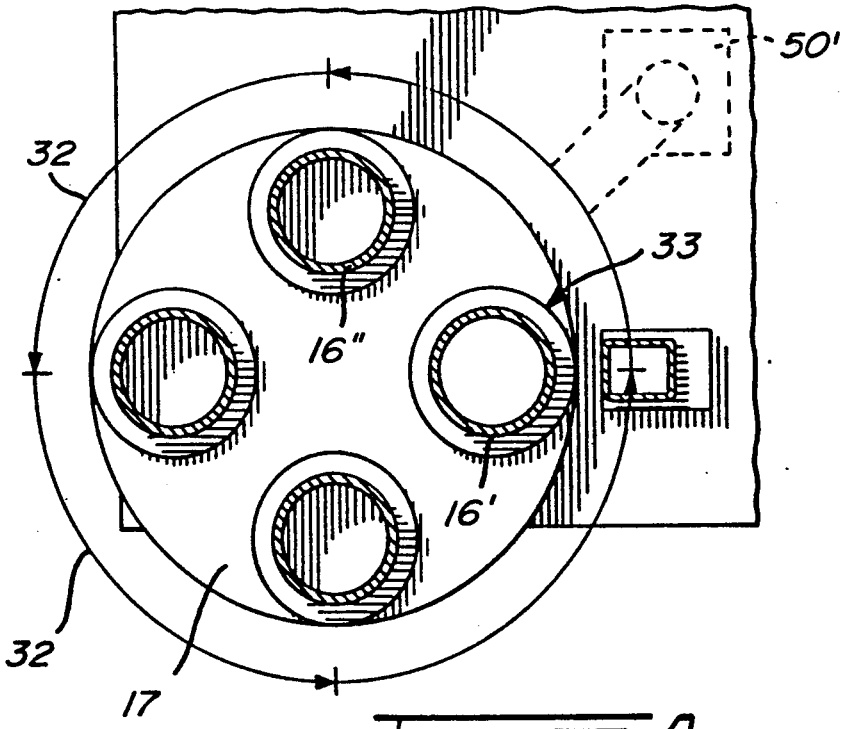
FIG. 4 is a cross-section view along cross-section lines 4—4 of FIG. 1.

After each of the cylinder housings 28 has been loaded with a cloth article 11, the piston 30 is operated to release the cloth article from each transfer cylinder portion, and their associated transfer pistons 31 are operated whereby their piston heads 32 extend within the transfer cylinder portion 9 and push the cloth article 11 into the discharge container 16 positioned thereunder. After the piston 30 is reactivated to close the discharge gates 29 the turret 17 is automatically operated by the control circuit to make a 90-degree turn, as indicated by arrows 32 in FIG. 4. The four discharge containers 16 are thus displaced and line up with adjacent transfer cylinder portions 9 of the loading conduits and over the discharge position, as indicated by reference numeral 33 in FIG. 4. As can be seen from FIG. 4, once the container 16" has moved in the direction of arrows 32 through two more sequences, it has then been loaded with three cloth articles. It then moves to the discharge position 33 where the three cloth articles are discharged. The container 16" at its initial position has a single cloth article therein. After a 90-degree turn a further article is inserted, and then a third article after the next 90-degree turn. Accordingly, the containers are loaded in sequence and discharged one by one, in series, at position 33. If four cloth articles were required to be inserted in a bag, then there would be five discharge containers and four loading conduits, and the turret would be displaced in different increments of spacing.

Figure 2:
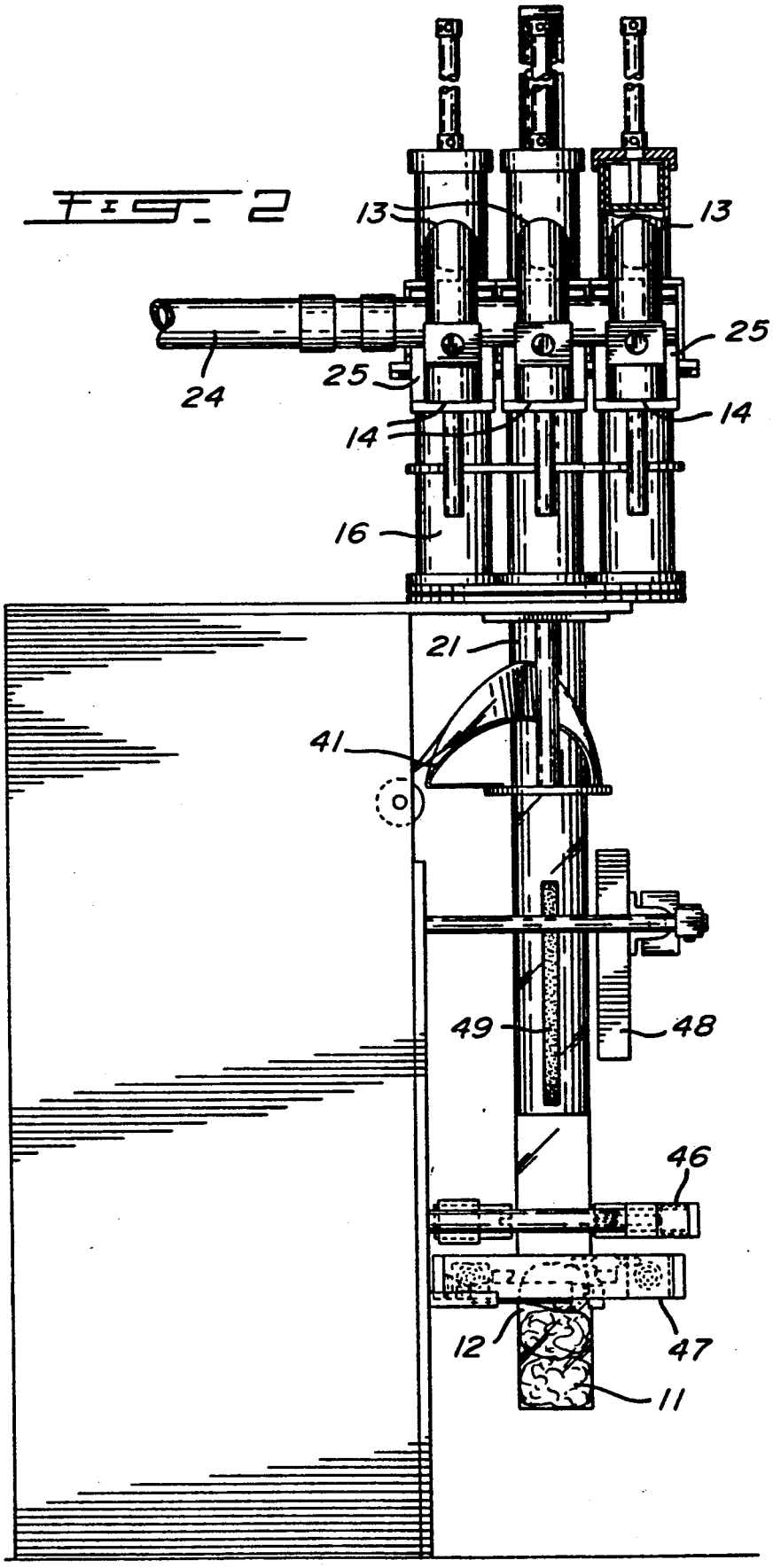
FIG. 2 is a side view, partly fragmented, of FIG. 1.
Figure 5:
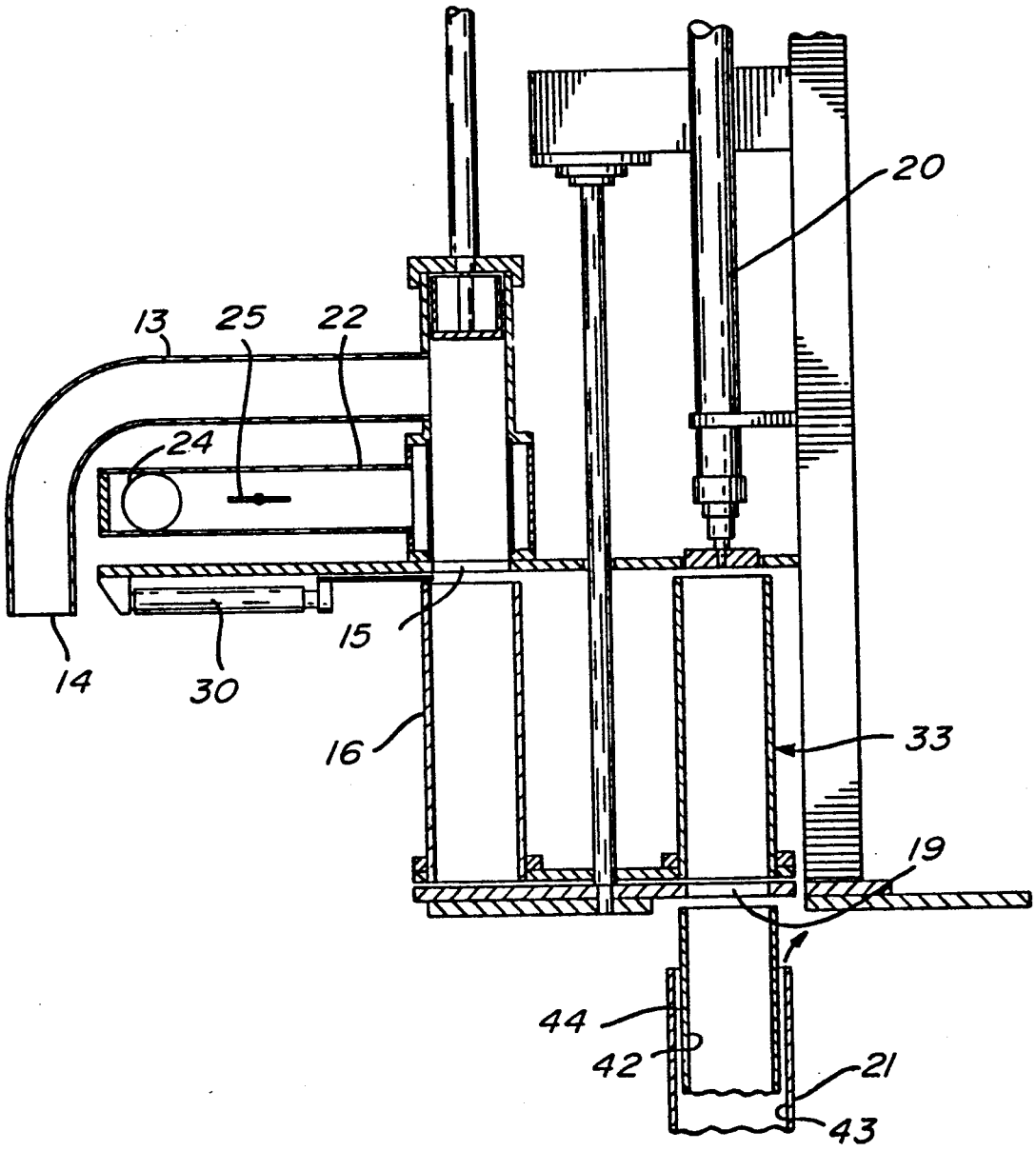
FIG. 5 is a side section fragmented view of the top part of the machine illustrating the novel packaging feature of the present invention.
Figure 8:
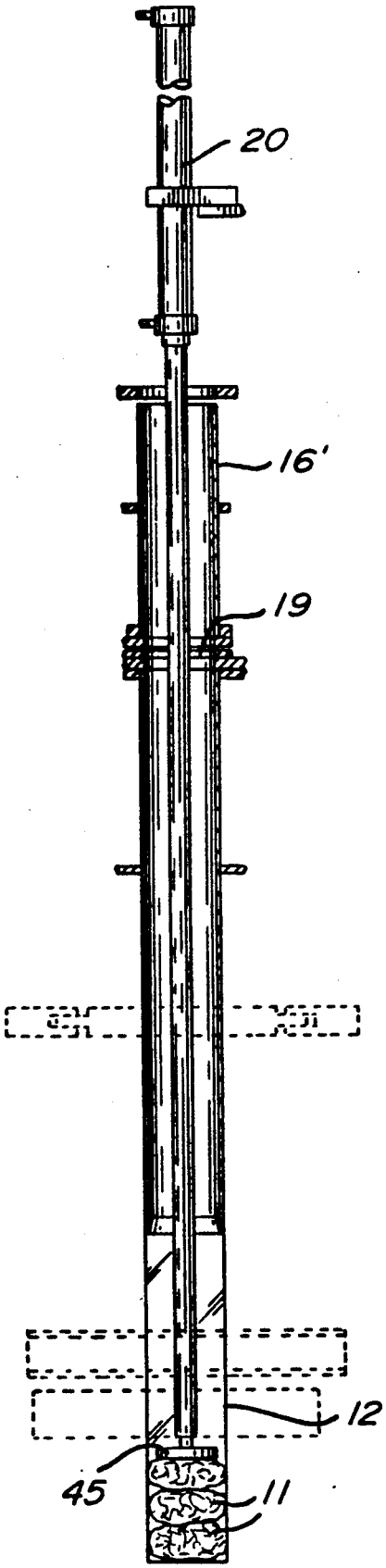
FIG. 8 is a section view showing the transfer of the cloth articles from the discharge conduits into a containment bag.

Referring now to FIGS. 1, 2 and 8, there is shown a bag forming device 40 disposed below and aligned with the discharge position 33 where the container 16' being discharged is located. The bag forming device 40 is of a type known in the art and modified to adapt to the present invention. It comprises an elongated cylinder 21 about which a bag is formed from a roll of film material 41. As shown in FIG. 5, a feed tube 42 is aligned with the discharge opening 19 and extends inside the elongated cylinder 21 concentrically spaced from an inner wall 43 thereof to form a vent passage 44 therebetween so that air is expulsed therethrough when the unloading piston 20 is actuated towards its full extended position, as shown in FIG. 8. The movement of the product within the cylinder and the bag 12 will cause air to move upwardly through this passage 44.

Once the loading container 16' reaches the discharge position 33, the control circuit 26 actuates the unloading piston 20 so that its piston head 45 is extended through the feed tube 42 to push the cloth articles 11 through the tube and into the bag 12 formed at the bottom of the elongated cylinder 21. The piston head 45 is then retracted by the control circuit and immediately thereafter a clamping device 47 is actuated to clamp the bag with the cloth articles 12 therein to prevent the articles from being drawn out by the retraction of the piston head 45. A sealing bar 46 is then actuated to form a seal at the top end of the bag and at the same time to seal the bottom end of the next bag to be formed. The sealing head 46 is also equipped with a severing means to simultaneously cut the bag.

As herein shown, the film material 41 is drawn about the elongated cylinder 21 and a side seal is formed by the vertical sealing channel 48. Drive belts 49 positioned on each side of the tube of film material drives the film material downwardly. The drive speed of these drive belts 49 is synchronized with the operation of the packaging head of the machine, and this is also controlled by the control circuit 26.

During the unloading cycle of the container 16' the loading conduits 13 have all been loaded with a further cloth article. Once the third loading conduit is filled the indexing motor 50' (see FIG. 4) is operated to move the turret another quarter turn so that the transfer cylinder portions of the loading conduit can be unloaded into the three discharge containers 16 positioned thereunder, and meanwhile the fourth discharge container 16' is being unloaded again.

The method of operation of the packaging machine will now be summarized. Firstly, the control circuit operates the first valve 25 of the first loading conduit 13 and a cloth article is introduced at the loading end 14 of that conduit. A photocell, not shown, detects the presence of the article in the perforated housing 28 and causes the control circuit to close the valve 25 of the first loading conduit and open the valve 25 of the second conduit where a second cloth article is introduced, and this sequence is repeated between the first to the third conduits. After all three perforated housings 28 are loaded with a single cloth article, the discharge gates 29 are all opened by the actuation of piston 30. Simultaneously the transfer pistons 31 eject the articles 11 into a respective one of three discharge containers 16 positioned thereunder. Thereafter, the discharge gates 29 are closed and the loading sequence is repeated with respect to the loading conduits 13. During this loading sequence the turret 17 is operated one-quarter turn to discharge the discharge container 16 at position 16' which has been loaded with three cloth articles 11. The discharge is effected by an unloading piston 20 which pushes the articles through a feed tube and into a containment means, such as the plastic bag 12 formed by the bag forming device 40 positioned under the discharge position 33 of the turret. Of course, other types of packages may be retained under the discharge position 33 to receive the articles therein, and the stroke of the unloading piston 20 may be adjustable. Also, if the articles 11 have a greater specific gravity, then they would fall into the containment means by their own weight and it may not be necessary to have an unloading piston.

The specific construction of the control circuit and its interconnection with various sensors is quite obvious to a person skilled in the art after studying the present description. As herein shown, the control circuit 26 is provided in a housing 50 having various switches 51 to switch the machine on and off. Counters may also be provided on this housing to indicate the number of packages made in a specific time period.

It is within the ambit of the present invention to cover any obvious modifications of the preferred embodiment described herein, provided such modifications fall within the scope of the appended claims.

We claim:

1. A packaging machine for inserting two or more light-weight cloth articles in a containment means, said machine comprising two or more loading conduits each having a loading end and a discharge end, controlled airflow means associated with said conduits for conveying said cloth articles therein, a retention housing at said discharge end of each of said loading conduits to retain therein a cloth article introduced at said loading end, transfer means to simultaneously transfer said cloth articles in said retention housing of each of said loading conduits into an associated discharge means, unloading means to discharge a predetermined number of cloth articles positioned in said discharge means into a containment means, said discharge means being comprised of three or more holding containers, means to displace said holding containers serially under said housings of said loading conduits and to a discharge position below said unloading means, said holding containers being oriented one adjacent said unloading means and the others disposed under a respective one of said housings of said loading conduits to receive said cloth article from all of said housings simultaneously.

2. A packaging machine as claimed in claim 1 wherein each said retention housing has an automatic controlled discharge gate for releasing said cloth articles retained in said housing.

3. A packaging machine as claimed in claim 2 wherein said transfer means comprises ejection means to transfer said cloth article into an associated discharge means after said discharge gate is opened.

4. A packaging machine as claimed in claim 3 wherein said ejection means is a piston head disposed in a top portion of a transfer cylinder portion of each of said loading conduits and actuable by a piston cylinder mounted on top of said transfer cylinder portion, said retention housing being an open-ended perforated cylinder disposed in said transfer cylinder portion, said transfer cylinder portion having an open bottom end which is closed by said discharge gate.

5. A packaging machine as claimed in claim 4 wherein said controlled air flow means comprises a vacuum conduit connected to each of said loading conduits, each vacuum conduit having a valve in an exit conduit section thereof to connect and disconnect a vacuum thereto, control circuit means to open and close said valves, said exit conduit section being disposed adjacent said perforated cylinder, said valve when open applying a suction from an end of said exit conduit section to cause air to flow from said loading end of said loading conduit and through said perforated cylinder housing and out through said exit conduit section.

6. A packaging machine as claimed in claim 5 wherein said holding containers are mounted on a turret displaceable under and aligned with said housings, said holding containers being open-ended containers displaceable about a circumferential path over a stationary flat bottom wall surface having an opening at said discharge position, said unloading means being a piston actuable to push a predetermined number of cloth articles released from said open-ended container loaded at said discharge position into said containment means.

7. A packaging machine as claimed in claim 6 wherein a bag forming device is disposed below said opening at said discharge position and comprises an elongated cylinder about which a bag is formed from a roll of film material, a feed tube aligned with said opening at said discharge position and extending inside said elongated cylinder and concentrically spaced from an inner wall thereof to form a vent passage therebetween, sealing means spaced below and along said elongated cylinder to form a sealed open end tubular pouch, said cloth articles being pushed into said pouch, clamping means to retain said articles in said pouch prior to severing and sealing said open end of said tubular pouch to form a bag with said cloth articles therein.

8. A packaging machine as claimed in claim 5 wherein said means to displace said holding containers is comprised of a turret having said three or more holding containers mounted thereon, each positioned under one of said retention housings and one at said discharge position, said holding containers being displaced serially under said retention housings and at said discharge position by an indexing drive mechanism controlled by said control circuit means, said control circuit means also controlling said unloading means at said discharge position to transfer a predetermined number of said cloth articles out of said holding container at said discharge position.

9. A packaging machine as claimed in claim 8 wherein there are three of said loading conduits having their discharge ends positioned at three consecutive 90-degree positions on an arc of a circle, there being four of said holding containers positioned respectively at four 90-degree positions along said arc of a circle with three of said holding containers aligned with said discharge ends of said three loading conduits.

10. A packaging machine as claimed in claim 2 wherein said cloth articles are nylon stockings.

11. A method of packaging two or more light-weight cloth articles in a containment means, said method comprising the steps of:

(i) conveying a cloth article in each of two or more loading conduits by controlled air flow means;

(ii) retaining said cloth articles in retention means associated with each of said loading conduits;

(iii) simultaneously transferring said cloth articles from said retention means of said loading conduits into associated ones of three or more discharge means;

(iv) accumulating a predetermined number of said articles in each of said discharge means, (v) displaying each of said discharge means in a serial path and in alignment with said retention means of said loading conduits to facilitate the transfer and accumulation of said articles in each of said discharge means, (vi) discharging the articles contained within one of said discharge means at a discharge position adjacent an unloading means after it has accumulated said predetermined number of said articles.

12. A method as claimed in claim 11 wherein step (iii) comprises retracting a discharge gate from a discharge end of each of said loading conduits and simultaneously ejecting said cloth article from said retention means into its associated discharge means.

13. A method as claimed in claim 11 wherein step (vi) comprises pushing said accumulated cloth articles into a feed tube having a bag formed of film material retained at an end thereof to receive said predetermined number of cloth articles therein.

* * * * *